United States Patent [19]

Cutter

[11] 3,967,336

[45] July 6, 1976

[54] PUNCHING AND BINDING APPARATUS

[75] Inventor: James W. Cutter, Los Altos, Calif.

[73] Assignee: NSC International Corporation, Hot Springs, Ark.

[22] Filed: Apr. 14, 1975

[21] Appl. No.: 567,622

[52] U.S. Cl. ..... 11/1 AC; 83/590
[51] Int. Cl.[2] ..... B42C 19/00
[58] Field of Search ..... 11/1 AC; 83/590

[56] References Cited

UNITED STATES PATENTS

| | | | |
|---|---|---|---|
| 2,898,613 | 8/1959 | Frederick | 11/1 AC |
| 3,060,780 | 10/1962 | Stuckens | 11/1 AC X |
| 3,122,761 | 3/1964 | Bouvier | 11/1 AC |
| 3,125,887 | 3/1964 | Bouvier et al. | 11/1 AC X |
| 3,699,596 | 10/1972 | Lyon | 11/1 AC |
| 3,793,660 | 2/1974 | Sims | 11/1 AC |

*Primary Examiner*—Lawrence Charles
*Attorney, Agent, or Firm*—Boone, Schatzel & Hamrick

[57] ABSTRACT

A combination punching and binding machine for gang punching a stack of sheets and binding the sheets with a pre-curled plastic "comb-binding" element. The machine has a manually actuated lever which, when operated in one direction actuates the punches, and when operated in the opposite direction, laterally moves a comb upon which the binding element is placed, and then actuates a plurality of hook elements to uncurl the curled splines of the binding element for receiving the punched sheets.

12 Claims, 11 Drawing Figures

Fig_1
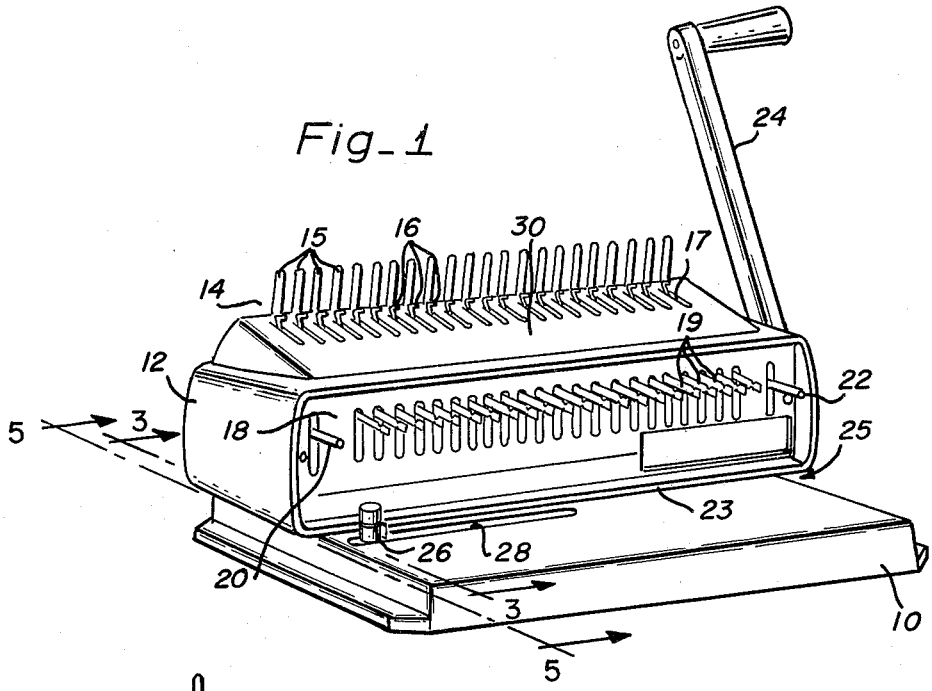
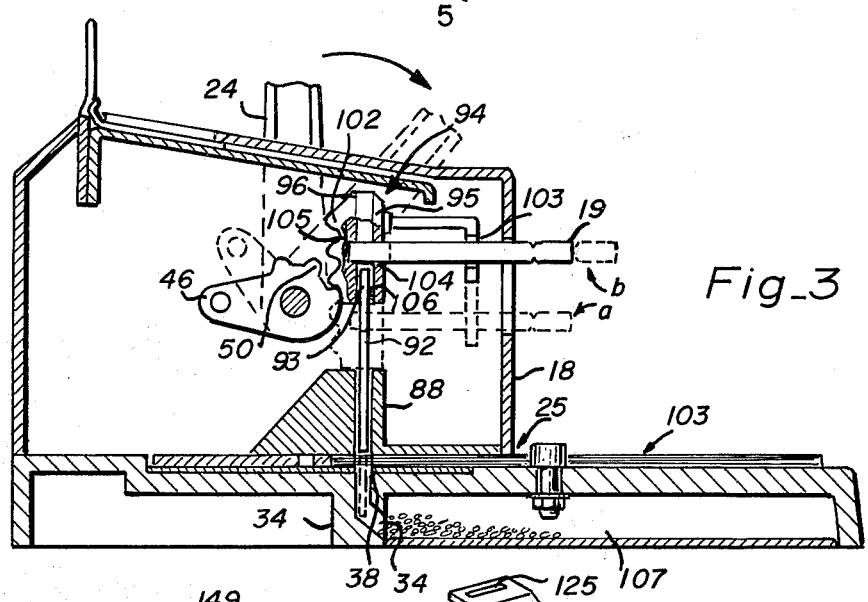
Fig_3
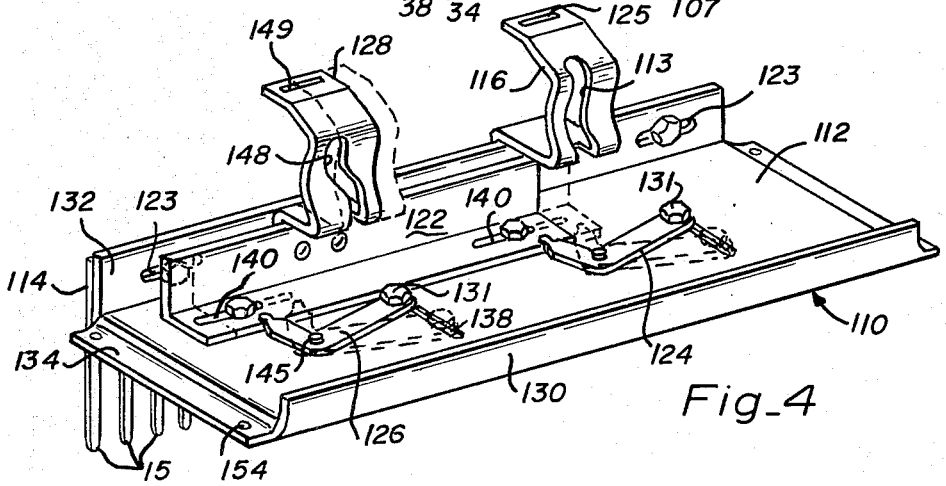
Fig_4

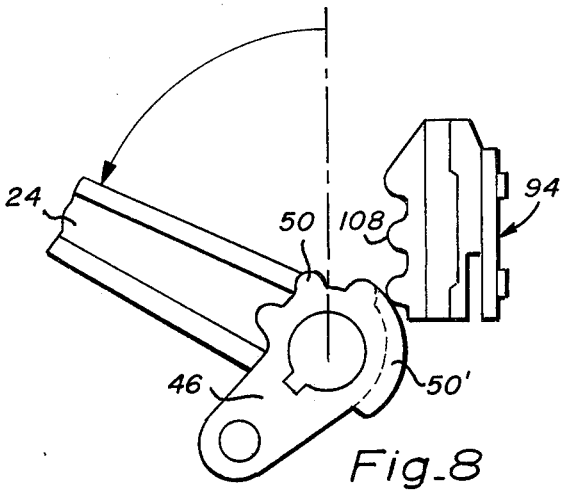
Fig_8
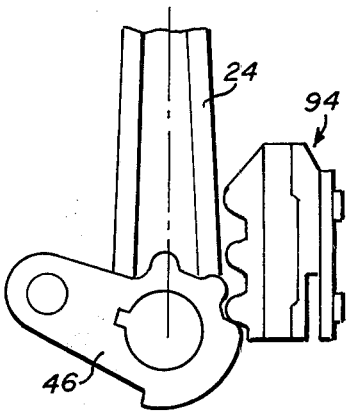
Fig_9
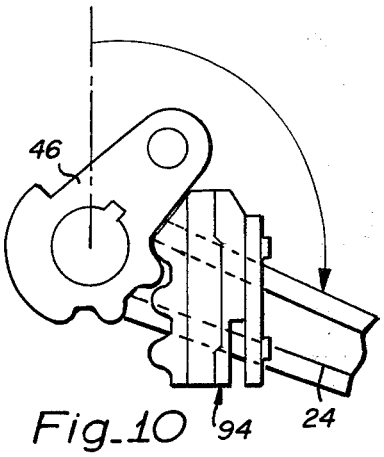
Fig_10
Fig_11
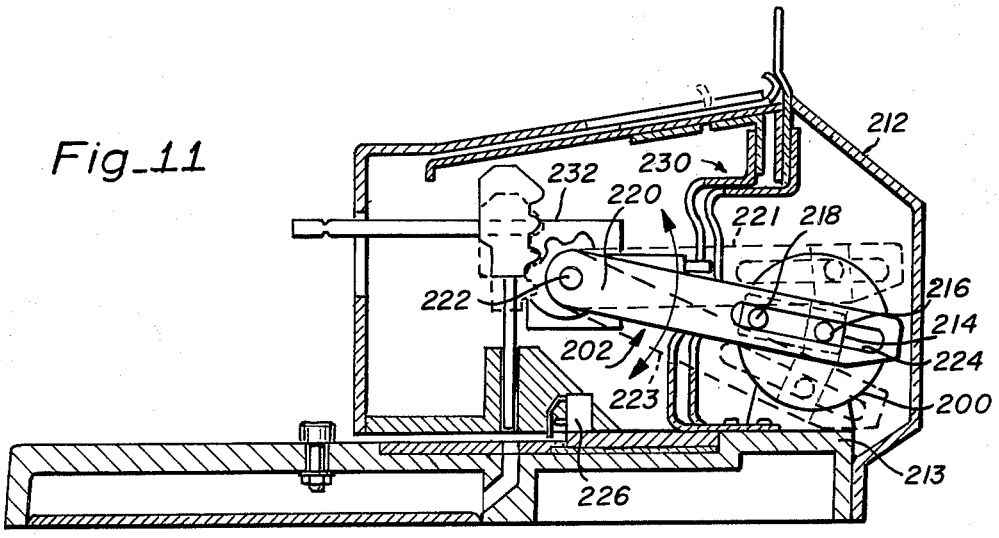

PUNCHING AND BINDING APPARATUS

BACKGROUND OF THE INVENTION

1. Field of the Invention

The present invention relates generally to document binding apparatus, and more particularly to a combination punching and binding machine for punching sheets and then binding the sheets with a plastic comb binder.

2. Description of the Prior Art

Heretofore, numerous devices have been provided for facilitating the binding of documents, and the like, with a flexible binding known as a comb-binder. The prior art devices usually include means for punching a plurality of holes along an edge of the documents to be bound, and means for aiding in the insertion of the binder comb teeth through the holes. Examples of such devices are disclosed in the U.S. Pat. Nos. to Lyon, 3,669,596; Bouvier, 3,227,023; Bouvier, 3,122,761; and Stuckens, 3,060,780.

Although these prior art binding devices clearly accomplish the intended result in an acceptable fashion, they suffer from disadvantages associated with undue mechanical complexity requiring a relatively large number of machined parts and are thus relatively expensive to manufacture.

SUMMARY OF THE PRESENT INVENTION

It is therefore a principal object of the present invention to provide an improved binding device having simple mechanical components not requiring high machine tolerances.

Briefly, the preferred embodiment of the subject binding device includes an improved binder inserting mechanism and an improved punch driving mechanism. The binder inserting mechanism includes a pair of actuating arms affixed to a lever operated main shaft, a first laterally moving cam which is driven by one of the actuating arms and which in turn moves the binder holding comb laterally, and a second laterally moving cam which is driven by the other actuating arm and which, through a linkage mechanism, moves the binder spreading hook plate away from the holding comb. The punch driving mechanism includes a simplified rack and pinion structure and associated punch locking structure.

An important advantage of the present invention is that due to the mechanical simplicity of the improved device, the cost of making and assembling the several operative components has been substantially reduced compared to prior art devices.

These and other objects and advantages of the present invention will no doubt become apparent after having read the following detailed description of the preferred embodiments illustrated in the several figures of the drawing.

IN THE DRAWING

FIG. 1 is a perspective view of a punching and binding machine in accordance with the present invention;

FIG. 3 is a partial sectional view taken along the line 3—3 of FIG. 1;

FIG. 4 is an inverted perspective view showing the relative positioning of the comb, bell crank assembly, and cams of the comb assembly and bell crank assembly, respectively;

FIGS. 8, 9 and 10 illustrate an alternate embodiment of the punch driving pinion and its sequential operation as the operating lever is moved from the binding position through the neutral position and into the punching position; and FIG. 11 is a sectional view of an alternative motorized embodiment taken just inside the right side cover.

DETAILED DESCRIPTION OF THE PREFERRED EMBODIMENT

Figure 2:
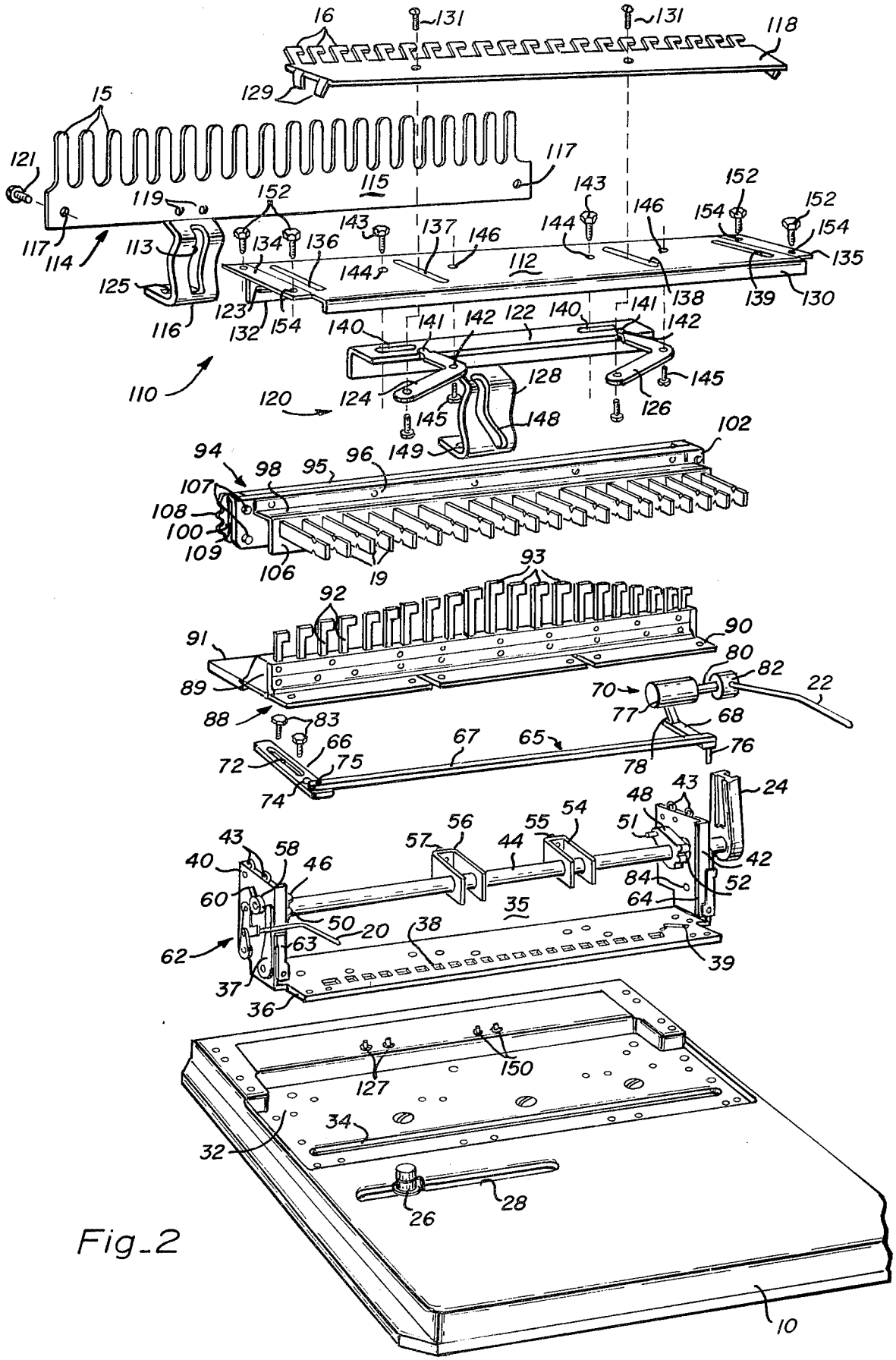
FIG. 2 is an exploded view showing the internal components of the machine illustrated in FIG. 1.

Referring now to FIG. 1 of the drawing, a punching and binding machine in accordance with the present invention is shown to include generally a base 10 and an upper housing 12 having a plurality of appendages extending therefrom. More particularly, projecting from the upper surface of housing 12 is a comb 14 including a plurality of vertically extending teeth 15 and a corresponding plurality of hooks 16 extending through slots 17. An apertured face plate 18 is affixed to the front side of housing 12 and has a plurality of punch selector pins 19 extending therethrough along with a binder adjustment lever 20 and a margin adjustment lever 22. The lower edge 23 of the front of housing 12 is spaced from the upper surface of base 10 to provide a paper receiving slot 25. An actuating lever 24 is affixed to a shaft extending through the right side of housing 12. The exposed upper surface of base 10 is plane and flat with the exception that a side guide adjustment knob 26 is provided in a slot 28 extending across the upper surface of base 10 parallel to the front edge of housing 12.

In operation, a stack of paper or other sheet material is placed upon the top surface of base 10 and one edge is inserted into slot 25 with another edge positioned against guide 26. Actuating level 24 is then rotated forward until the punches are driven through the stack. Lever 24 is then returned to its upright position and a plastic comb binder is placed over the teeth of comb 14 with the backbone of the binder positioned to the rear of comb 14. Lever 24 is then rotated toward the rear causing the hooks 16 to engage the fingers of the comb binder and to straighten them out. The punched stack of paper is then removed from the front of the machine and is placed over the extended binding fingers with the fingertips in registration with the punched holes. Lever 24 is then rotated forward to retract the hooks 16 and to allow the binding fingers to curl upwardly and thereby extend through the punched holes. When lever 24 reaches the full upright position the resilient fingers of the binder will have extended themselves through the punched holes and returned to their normal curled position and the now bound stack of papers can be lifted from comb 14.

To now describe the working components of the preferred embodiment, reference is made to FIG. 2 of the drawing which is an exploded diagram showing the covered portion of base 10 and the operative mechanisms disposed within the interior of housing 12. As illustrated, in addition to the side guide adjustment knob 26 and slot 28 the upper surface of base 10 is provided with a recessed portion 32 and an elongated slot 34 which extends laterally across the recessed portion. As will be explained in more detail below, slot 34 provides a discharge passage for punched paper chips. The portion of base 10 covered by housing 12 also includes numerous apertures for receiving various fasteners, screws, bolts, etc.

Positioned above base 10 is an actuating assembly 35 including a die plate 36 having a plurality of female dies 38 formed therein near the forward edge thereof, and an angularly disposed slot 39 which will be described in more detail below. Assembly 35 also includes a pair of end supports 40 and 42 and an actuating shaft 44 which is journaled at its respective ends to supports 40 and 42. Supports 40 and 42 are provided with threaded bores 43 for attachment of the binder assembly as will be discussed in more detail later. Affixed to the right-most end of shaft 44 is the actuating lever 24. Affixed to shaft 44 proximate the facing sides of supports 40 and 42 are eccentrics 46 and 48 including pinion gears 50 and 52, respectively. Also carried by shaft 44 but disposed along the center-most portion thereof are a pair of camming arms 54 and 56 frictionless buttons 55 and 57, respectively, extending from the rear-most extremities thereof. Affixed to the left-most end of shaft 44 and outside the end support 40 is an annular collar 58 having a radially extending release pin 60 extending therefrom. Affixed to the outside base of support 40 is a binder size adjustment mechanism 62 which will be described in more detail below. Note that the forward-most portions of supports 40 and 42 are turned inwardly to provide guide edges 63 and 64 which will be further referred to below.

Die plate 36 is affixed to base 10 within the recessed portion 32 and is positioned relative thereto such that the dies 38 are aligned above the slot 34. The attachment is made with machine screws, bolts, or other suitable means.

Shown above the actuating assembly 35 is a punch margin adjust assembly 65 including a cam plate 66, a margin rail 67, a rail link 68 and a drive assembly 70. Cam plate 66 is provided with an elongated mounting slot 72 and an angled slot 74 which receives a pin 75 extending through the left end of rail 67. Although not clearly shown in the drawing, the slot 74 is identical in length and angular relationship (i.e., is parallel to) slot 39. The opposite end of a rail 67 is affixed to link 68 by a pin 76 which extends a short distance beneath the bottom surface of link 68. Drive assembly 70 includes a fitting 77 having a spring-loaded pin 78 extending therefrom to driveably engage the rear most end of link 68, a shaft 80 having one end affixed to fitting 77, and a collar 82 affixing the margin adjust lever 22 to the other end of shaft 80.

Assembly 65 is mounted to the top side of die plate 36 by securing cam plate 66 thereto with screws 83 and by inserting pin 76 into slot 39. Assembly 70 is secured to pin support 42 by journaling the shaft 80 within the aperture 84. Thus, when lever 22 is raised or lowered shaft 80 and fitting 77 are rotated causing pin 78 to move rail link 68 as constrained by the movement of pin 76 in slot 39, guide rail 67 will be caused to move toward or away from the line of dies 38.

Since slot 74 in plate 66 is aligned parallel to the die plate slot 39, and the respective ends of rail 67 are constrained by the pins 75 and 76 to move along the slots 74 and 79, it will be appreciated that rail 64 will at all times remain parallel to the line of dies 38 thereby providing a selectably positionable punch margin guide.

Also shown above die plate 36 is a punch guide assembly 88 including a guide structure 89, a front plate 90, a rear plate 91, and punches 92. Guide structure 89 is provided with a multiplicity of guiding apertures for receiving and supporting in an upright position the punches 92. Rear plate 91 extends below and rearward of guide structure 89 and serves as a spacer for spacing the lower extremity of guide structure 89 above die plate 36 to form the paper receiving slot 25 as will be further described below. Punches 92 are of a conventional configuration including enlarged head portions 93 for contact by a pressure assembly 94 as will be described in more detail later.

Assembly 88 is mounted on the top side of die plate 36 with the punches 92 disposed above the female dies 38. Machine screws, bolts, or other suitable means are used to secure rear plate 91 to die plate 36.

Shown immediately above punch assembly 88 is a pressure bar assembly 94 including a pair of rectangularly-shaped bars 95 and 96 disposed in spaced-apart parallel relationship to define a slot for receiving the head portions of punches 92, an elongated bracket 98, rack gears 100 and 102, and a plurality of punch selector pins 19. As is perhaps shown more clearly in the broken away section of FIG. 3, the selector pins 19 extend through apertures 103, 104 and 105 in bracket 98, and bars 95 and 96 respectively, with each set pin being positioned directly above the top of one of the punches 92. Set screws 106 (see FIG. 3) also extend through the lower portions of bars 94 and 96 slightly offset relative to pins 19 and serve as lifters which engage the lower edge of the punch heads 93.

The rack gears 100 and 102 are bolted the ends of bars 95 and 96 by suitable bolts 107 and serve as separating spacers therefore. Gears 100 and 102 are provided with three gear teeth 108 on the rear-facing side for engaging the pinion teeth 50 and 52 respectively, and also include vertically-extending grooves 109 in their laterally-facing sides for mating with the edges 63 and 64 of end supports 40 and 42.

Assembly 94 is mated to assemblies 35 and 88 by first removing the set screws 106 and slidably mating slots 109 with guide edges 63 and 64. Note that as assembly 94 is dropped into place rack gear teeth 108 will mesh with pinion teeth 50 and 52. Shaft 44 is then rotated by pulling lever 24 toward the front, thereby lowering assembly 94 far enough that the set screws can be inserted and pass beneath the punch heads 93. Subsequent rotation of lever 24 toward the rear will raise assembly 94 and it in turn will lift punches 92 high enough to clear slot 25.

As indicated in FIG. 3, it will be noted that the set pins 19, when in the position shown in solid lines, will engage the heads of punches 92 and force the punches downwardly as assembly 94 moves downwardly into the position shown by *a*. However, by selectively pulling the pins 19 outwardly away from face plate 18 into the position shown by the dashed lines *b*, the selected punches can be inactivated.

The binding assembly shown exploded at 110 includes an alignment plate 112, a comb plate 114 and its driving cam 116, a hook plate 118, and a bell crank assembly 120 including a drive bar 122, bell cranks 124 and 126, and a driving cam 128.

Alignment plate 112 includes downturned front and rear edges 130 and 132 respectively, and laterally extending apertured mounting flanges 134 and 135. Plate 112 is provided with four front-to-rear-extending guide slots 136, 137, 138 and 139.

Comb plate 114 includes flat base portion 115 and vertically-extending fingers 15. Mounting apertures 117 are provided at each end of base portion 115. Cam 116 is comprised of a rigid metal bar having its mid-portion arcuately bowed to be concentric with shaft 44 (see FIG. 5), its upper end deformed vertically for affixment to comb plate 114 with suitable bolts or spot welds 119, and its lower end deformed horizontally to slideably engage the top surface of base 10.

Cam 116 is provided with a camming slot 113 which is configured as illustrated for receiving the button 57 of camming arm 56. As will be discussed in more detail below, the angled portion of slot 113 causes cam 116 to drive comb plate 114 laterally as shaft 44 is rotated.

Comb plate 114 is mounted to edge 132 of alignment plate 112 by passing bolts or rivets 121 through apertures 117 and laterally elongated apertures 123. The elongated apertures 123 permit comb plate 114 to slide laterally along the face of edge 132. A slot 125 receives alignment studs 127 on base 10.

Hook plate 118 includes a plurality of slightly upturned hooks 16, and downturned side edge tabs 129. The number and location of hooks 16 are chosen to be complementary with the number and location of teeth 15 on comb plate 114. Hook plate 118 is slideably mounted upon the upper surface of alignment plate 112 by inserting tabs 129 in guide slots 136 and 139, and is pivotally connected to bell cranks 124 and 126 by bolts or rivets 131 which extend through slots 137 and 138 in plate 112. The driving bar 122 of bell crank assembly 120 is an angle iron shaped bar having a pair of elongated slots 140 in the horizontal segment. A pair of pivot notches 141 are provided in the front edge thereof for receiving the rounded tips 142 of the bell cranks 124 and 126.

As is perhaps more clearly shown in FIG. 4 of the drawing, which is an inverted perspective view of the binding assembly 110, bar 122 is slideably mounted to the lower surface of alignment plate 112 by bolts or rivets 143 which pass through apertures 144 in plate 112 and through slots 140 in bar 122. The elbows of cranks 124 and 126 are pivotally attached to the bottom surface of plate 112 by suitable pivot bolts or rivots 145 which extend through holes 146 in plate 112.

Cam 128 is comprised of a rigid bar having its mid-portion arcuately bowed to be concentric with shaft 44, its upper end deformed horizontally to slideably engage the top surface of base 10. Cam 128 is provided with a camming slot 148 which is configured as illustrated for receiving the button 55 of camming arm 54. The angled portion of slot 148 causes cam 128 to drive bar 122 laterally as shaft 44 is rotated. A slot 149 receives alignment studs 150 on base 10.

Once the binding assembly 110 is assembled it is mounted to end supports 40, 42 (FIG. 2) by screws 152 which are passed through holes 154 in alignment plate flanges 134 and 135 and threaded into threaded bores 43 of end supports 40 and 42. Exterior housing 12 (FIG. 1) is positioned around the punching and binding assemblies and secured by suitable means. The top plate 30 (FIG. 1) is then positioned over hook plate 118.

FIG. 3 is a partial cross-sectional view taken along the line 3—3 of FIG. 1 showing the interrelationships between the various punching components. As is shown in the solid lines, with actuating lever 24 in the vertical position, the lowermost gear tooth of pinion gear 50 contacts the lowermost nub of rack gear 102, thereby holding the punch assembly 94 in the raised position shown. As lever 24 is rotated forwardly, in the direction of the arrow and into the broken line position shown, pinion gears 50 mesh with rack gears 102, forcing the punch assembly 94 downwardly. With punch selector pins 19 in in the fully inward position, the lowering of assembly 94 causes pins 19 to engage the tops of punches 92 and force them downwardly through punch guide 88 and into contact with the sheets of paper 103 lying therebetween in slot 25. As punches 92 force their way through dies 38, holes of predetermined size are formed in the sheets 103 with the chips falling through slot 34 into a retaining chamber 107. Hand lever 24 is then rotated counterclockwise causing pinion gears 50 to drive rack gears 102 and assembly 94 upwardly. As assembly 94 moves upwardly, the lower edges of punch heads 93 are engaged by set screws 106, thereby causing punches 92 to be withdrawn from die plate 38 and the sheets previously punched.

FIG. 3, also illustrates the interrelationship between punch selector pins 19, pressure bar assembly 94 and punches 92. As is shown, the punch heads 93 pass between the bars 95 and 96, while selector pins 19 pass through apertures 103 in bracket 98 and 104 in the front bar 95, and extend through the back bar 96 passing directly over one of the punches 92. Selector pins 19 may selectively be pulled forward into the position illustrated by dashed lines b so as not to contact the top of punch 92 when pressure bar assembly 94 is forced downwardly during the punching operation. In this manner, certain punches may be omitted to provide a desired punch pattern.

Figure 5:
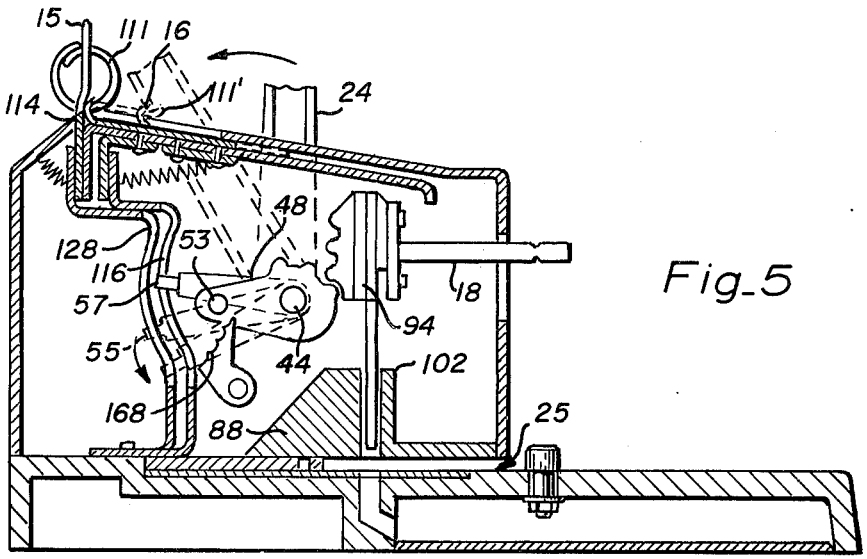
FIG. 5 is a sectional view taken along the line 5–5 of FIG. 1.
Figure 6:
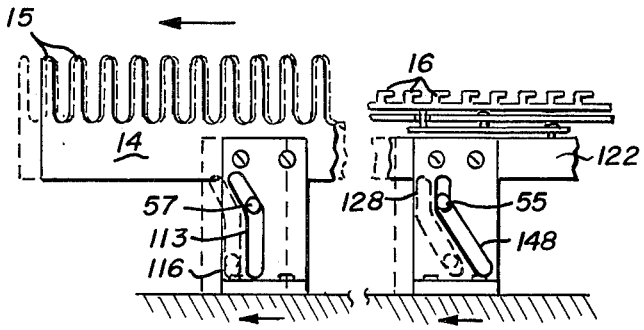
FIG. 6 is a fragmentary view showing the relative movement of the comb and hooks with respect to the movement of the cams.

FIG. 5 is a partial cross-sectional view taken along the line 5—5 showing the operation of the binder mechanism. As shown, with actuating lever 24 in the upright position frictionless buttons 55 and 57 are seated within the slots 113 and 148 of cams 116 and 128, respectively. As actuating lever 24 is pushed toward the rear of the machine in the direction of the arrow, buttons 55 and 57 travel downward in slots 113 and 148. As perhaps better shown in FIG. 6, this downward movement laterally displaces cams 116 and 128. When button 57 begins to descend down slot 113, it causes comb plate 114 to immediately begin moving toward the position shown by the dashed lines. A corresponding initial displacement of button 55 in slot 148 causes no initial displacement of hooks 16. This is to allow the initial movement of comb plate 114 to force the plastic binder fingers 111, shown in FIG. 5, beneath hooks 16 before hooks 16 begin their movement away from comb plate 114.

As buttons 55 and 57 descend further no additional displacement of comb plate 114 is effected, but cam 128 is caused to continue moving laterally. As can be understood from FIG. 4, the lateral movement of cam 128 causes drive bar 122 to shift likewise, thereby causing the attached bell cranks 124 and 126 to pivot about attachments 145 resulting in the translation of the hook plate attached thereto by bolts 131. As hooks 16 move away from comb plate 114, they spread the fingers 116 as shown by the dashed lines 111' Hooks 16 continue to move away from comb plate 114, opening the flexible fingers of the plastic binder, until the dog 53 on eccentric 48 contacts the notched stop 168 of the binder size adjustment mechanism 62. The binder adjustment mechanism will be described in more detail below.

The punched sheets are then placed over the extended fingers 111' and lever 24 is pulled forward causing hooks to retract toward comb plate 114. As they are freed, the fingers 111 curl upwardly intertwining the punched sheets. Comb plate 114 does not move until lever 24 is almost back to the full upright position and hooks 16 are adjacent comb plate 114. At that point comb plate 114 shifts laterally, removing the fingers 111 of the plastic binder from hooks 16 and allowing the bound sheets to be lifted away.

Figure 7:
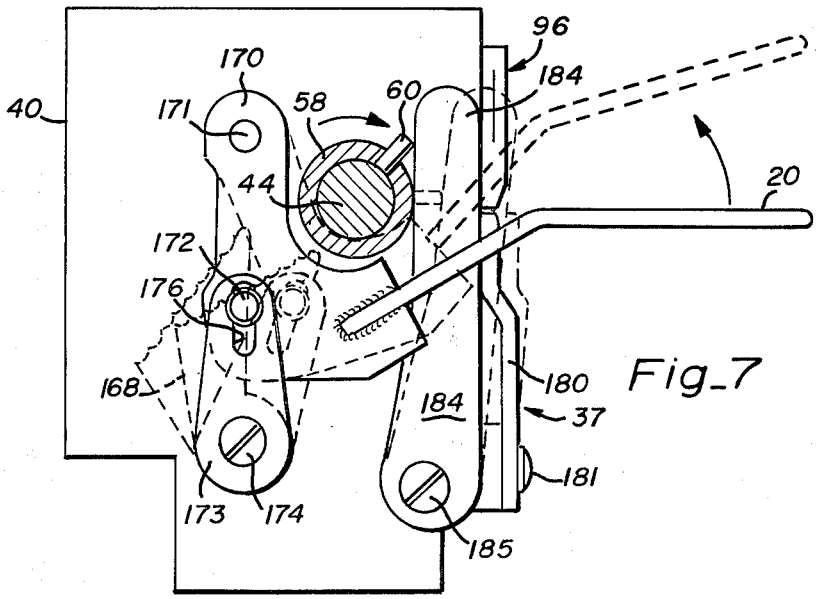
FIG. 7 is a fragmentary sectional view showing the posi-lock assembly and the binding size adjustment.

FIG. 7 is a partial end view of the actuating assembly 35 showing the binder size adjustment mechanism 62, and the posi-lock mechanism 37 of the present invention. The binder size adjustment mechanism 62 includes the adjusting rod 20, and L-shaped plate 170 which is pivotally attached to end support 40 at 171 and includes a laterally projecting pin 172, an eccentric 173 pivotally coupled to end support 40 by a bolt and shaft 174 and having an elongated aperture 176 at its distal end for receiving pin 172 and a notched stop disposed on the opposite side of end support 40 and coupled to the other end of shaft 174.

A adjustment rod 20 is moved upward or downward, pin 172 follows an arcuate path about pivot 171 and causes eccentric 173 to pivot about shaft 174. This rotational motion is transmitted through shaft 174 to stop 168 which likewise changes its position as indicated by the dashed lines 168'. Thus, as adjustment rod 20 is moved, stop 168 also moves a proportionate distance. As shown in FIG. 5, when pin 53 contacts stop 168, further rotation of eccentric 48 and main shaft 44 attached thereto is prevented.

FIG. 7 also illustrates the posi-lock mechanism 37. The posi-lock mechanism 37 includes a leaf spring 180 which is attached to end support 40 by a screw 181, and an arm 184 which is pivotally attached to end support 40 by a bolt 185. As indicated above, an annular collar 58 having a release pin 60 projecting therefrom is mounted on the end of shaft 44.

In the position illustrated, the posi-lock mechanism prevents downward movement of punch assembly 94 when the machine is being operated in the binding mode. With actuating lever 24 in the upright position, pin 60 does not contact arm 184 and the upper end of spring 180 lies beneath the end of pressure bar 96, thereby preventing assembly 94 from moving downward. Conversely, when lever 24 is rotated in the forward (punching) direction, pin 60 contacts arm 184, forcing it forwardly into spring 180, and in turn causing spring 180 to flex away from the end support 40, thereby allowing pressure bar 94 to be driven downwardly. One of the above-described mechanisms is preferably provided at each end of shaft 44.

Turning now to FIGS. 8, 9 and 10 of the drawing, an alternative embodiment of a punching assembly locking mechanism is shown which is somewhat simpler than the posi-lock mechanism just described in that it consists of a minor modification of the pinion gear piece 50. In the preferred embodiment the arcuate length of the third gear tooth is expanded as indicated at 50' so that when the actuating lever 24 is rotated into the binding position (FIG. 8) the expanded tooth 50' will engage the lower tooth of the rack gear 108 and prevent the punch assembly from falling. However, as the lever 24 is rotated back to the neutral position (FIG. 9) the lower tooth of rack gear 108 will mesh with pinion 50 and be driven downwardly thereby as lever 24 is rotated forward into the punching position (FIG. 10).

In FIG. 11 the principal operation components of a motorized embodiment are diagrammatically illustrated. This embodiment is similar to that previously described and illustrated in FIGS. 1–7 except that the manual operating handle and lever have been removed and an electric motor 200 and associated shaft driving linkages 202 have been added. Motor 200 is positioned in the rearmost portion of the machine housing 212 and is mounted to base 213.

Linkage 202 includes a rotary arm 214 secured to one end of the motor drive shaft 216 and a lever 220 affixed to one end of the machine actuating shaft 222. Arm 214 has a laterally extending pin 218 affixed to its outer end for mating with a slot 224 in lever 220 to driveably couple arm 214 to lever 220.

When motor 200 is energized and caused to rotate arm 214 through one complete revolution it will cause lever 220 to swing first into the punch actuating position indicated by the dashed lines 221 and then into the binder actuating position indicated by the dashed lines 223. Motor 200 may be energized by a housing mounted manual switch, a foot operated switch or a paper edge actuated microswitch 226. In the preferred embodiment a turn-off switch and other control circuitry (not shown) are also provided for limiting operation of motor 200 to one cycle per actuation.

A suitable clutch means shown generally at 232 may also be provided for selectively disengaging the binding mechanism 230 from shaft 222 except when needed. This allows the apparatus to be used solely as an electrical punching device without importing unnecessary mechanical movement to the binding mechanism. Alternatively, a reversible motor 200 may be coupled with suitable electrical control circuitry to enable either punching or binding action to be independently selected.

It is contemplated that after reading the above disclosure of the preferred embodiments, many additional alterations and modifications of the present invention will no doubt become apparent to those of skill in the art. Accordingly, it is to be understood that such disclosure is made for illustration only and is not to be considered limiting. Moreover, it is intended that the appended claims be interpreted as covering all such alterations and modifications as fall within the true spirit and scope of the invention.

What is claimed is:

1. Punching and binding apparatus, comprising:

punching means for punching apertures along an edge of a stack of sheet material;

binding means for inserting the flexible fingers of a comb binder through the punch apertures for binding the sheet material together and including, an elongated rigid comb plate member having a plurality of comb teeth, an elongated rigid hook plate having a plurality of hooks corresponding in number to the number of said comb teeth, and guide means to which said comb plate and said hook plate are mounted, said guide means permitting said comb plate to move in its longitudinal direction between a first position and a second position, said hook plate being mounted adjacent said comb means with its hooks being positioned proximate said comb plate and being movable away from said comb plate; and actuating means for actuating said punching means and said binding means including, an actuating shaft, a first camming means coupled to said comb plate and including a first camming surface, a second camming means coupled to said hook plate and including a second camming surface, a first arm extending radially from said shaft and having one end affixed thereto and an opposite end cammingly engaging said first camming surface, and a second arm extending radially from said shaft and having one end affixed thereto and an opposite end cammingly engaging said second camming surface;

whereby rotation of said shaft in one direction actuates said punching means and rotation of said shaft in the opposite direction causes said first arm to move said first camming means which in turn moves said comb plate from said first position to said second position and rotation of said shaft in said opposite direction also causes said second arm to move said hook plate away from said comb plate.

2. Punching and binding apparatus as recited in claim 1 and further comprising a base; and wherein said first camming means includes an elongated plate having an arcuately bowed midportion disposed concentric with said shaft, an upper end portion affixed to said comb plate, and a lower end portion slideably engaging said base.

3. Punching and binding apparatus as recited in claim 2 wherein said second camming means includes an elongated plate having an arcuately bowed mid-portion disposed concentric with said shaft, and upper end portion coupled to said hook plate, and a lower end portion slideably engaging said base.

4. Punching and binding apparatus as recited in claim 3 wherein the bowed end portions of said first and second camming means each includes slots formed therein, the edges of which respectively form said first and second camming surfaces.

5. Punching and binding apparatus as recited in claim 3 and further comprising linkage means including bell crank means pivotally affixed to said guide means and operatively coupling said second camming means to said hook plate.

6. Punching and binding apparatus as recited in claim 1 wherein said punching means includes a punch assembly movable between an upper position and a punching position, and rack gear means affixed to said punch assembly, said rack gear means having a plurality of gear teeth, and wherein said actuating means further includes pinion gear means affixed to said shaft for engaging said rack gear means to drive said punch assembly between said upper position and said punching position as said shaft is rotated back and forth, and holding means for holding said punch assembly in said upper position as said shaft is rotated in said one direction beyond that position which places said punch assembly in said upper position.

7. Punching and binding apparatus as recited in claim 6 wherein said holding means includes an arcuately enlarged lower gear tooth on said pinion gear means which slideably engages the lower gear tooth of said rack means.

8. Punching and binding apparatus as recited in claim 6 wherein said holding means includes a stop member pivotable between a punch assembly holding position and a release position, and means affixed to said shaft for causing said stop member to move from said holding position into said release position when said shaft is rotated in the direction which drives said punch assembly toward said punching position.

9. Punching and binding apparatus as recited in claim 6 and further comprising an adjustable stop for selectively limiting the rotations of said shaft in the binding direction.

10. Punching and binding apparatus as recited in claim 2 wherein said punching means further includes a slot for receiving an edge of the stack of sheet material to be punched, a margin stop means disclosed within said slot, and margin adjust means coupled to said stop means for selectively changing the position of said stop means relative to the punching components of said punching means.

11. Punching and binding apparatus as recited in claim 1 wherein said actuating means further includes an electric motor, an eccentric driven by said motor, and a lever means having one portion attached to said shaft and another portion engaged by said eccentric whereby energization of said motor causes said shaft to be rotated.

12. Punching and binding apparatus as recited in claim 11 wherein said actuating means further includes a clutch mechanism for selectively disengaging said first and second arms from said shaft whereby energization of said motor causes only said punching means to be actuated by rotation of said shaft.

* * * * *

UNITED STATES PATENT OFFICE

CERTIFICATE OF CORRECTION

Patent No. 3,967,336 Dated July 6, 1976

Inventor(s) James W. Cutter

It is certified that error appears in the above-identified patent and that said Letters Patent are hereby corrected as shown below:

Column 1, line 11, "comb-binder" should read --"comb-binder"--;

Column 3, line 22, after "56" insert --having--;

Column 3, line 66, "79" should read --39--;

Column 6, line 65, after "111'" insert --.--;

Column 7, line 26, "A" should read --As--;

Column 10, line 17, after "rack" insert --means--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*